US009975743B2

(12) United States Patent
Barnet et al.

(10) Patent No.: US 9,975,743 B2
(45) Date of Patent: May 22, 2018

(54) PULLEY

(71) Applicant: INO-ROPE, Concarneau (FR)

(72) Inventors: Julien Barnet, Tregunc (FR); Thibault Reinhart, Paris (FR)

(73) Assignee: INO-ROPE, Concarneau (FR)

( * ) Notice: Subject to any disclaimer, the term of this patent is extended or adjusted under 35 U.S.C. 154(b) by 185 days.

(21) Appl. No.: 14/901,266

(22) PCT Filed: Jul. 3, 2014

(86) PCT No.: PCT/EP2014/064202

§ 371 (c)(1),
(2) Date: Dec. 28, 2015

(87) PCT Pub. No.: WO2015/001028

PCT Pub. Date: Jan. 8, 2015

(65) Prior Publication Data

US 2016/0152452 A1 Jun. 2, 2016

(30) Foreign Application Priority Data

Jul. 3, 2013 (FR) ..... 13 01574

(51) Int. Cl.
*B66D 1/36* (2006.01)
*B63B 21/04* (2006.01)
(Continued)

(52) U.S. Cl.
CPC ..... *B66D 1/36* (2013.01); *B63B 21/04* (2013.01); *B63H 9/10* (2013.01); *B66D 3/04* (2013.01)

(58) Field of Classification Search
CPC .. B66D 3/04; B66D 3/046; B66D 1/34; B63B 21/04
See application file for complete search history.

(56) References Cited

U.S. PATENT DOCUMENTS 675,306 A 5/1901 St. John
1,739,847 A 12/1929 Linn
(Continued)

FOREIGN PATENT DOCUMENTS

DE 20 2010 001172 U1 4/2010
FR 2 565 656 A1 12/1985
(Continued)

OTHER PUBLICATIONS

R.C. Anderson, "The Rigging of Ships: In the Days of the Spritsail Topmast 1600-1720," Cornell Maritime Press, 1982, pp. 231-232.
(Continued)

*Primary Examiner* — Emmanuel M Marcelo
(74) *Attorney, Agent, or Firm* — Baker & Hostetler LLP

(57) ABSTRACT

A pulley comprises: a monobloc sheave comprising two opposing longitudinal faces, a transverse central recess and a concave external surface forming an annular groove which is provided in order to redirect a rope, the central recess and the concave external surface being fixed relative to each other, a fixing rope of the sheave, which extends through the central recess of the sheave, the fixing rope being in direct contact with the central recess, a spacer element which is arranged in order to space the fixing rope away from the longitudinal faces of the sheave.

20 Claims, 10 Drawing Sheets

(51) Int. Cl.
*B66D 3/04* (2006.01)
*B63H 9/10* (2006.01)

(56) References Cited

U.S. PATENT DOCUMENTS

| | | | | |
|---|---|---|---|---|
| 2,555,059 | A | 5/1951 | Schrader | |
| 2,762,607 | A | 9/1956 | Duncan | |
| 2,924,431 | A | 2/1960 | Chadbourne | |
| 3,744,837 | A | 7/1973 | Foster | |
| 4,251,061 | A | 2/1981 | Marshall | |
| 6,305,669 | B1 * | 10/2001 | Harken | B63H 9/10 254/412 |
| 7,673,851 | B2 * | 3/2010 | Lange | B66D 3/04 254/401 |
| 8,727,320 | B1 * | 5/2014 | Franta | B66D 3/04 254/389 |
| 9,254,989 | B2 * | 2/2016 | Kingery | B66D 5/32 |
| 2008/0197331 | A1 * | 8/2008 | Curchod | B66D 3/04 254/390 |
| 2009/0114893 | A1 | 5/2009 | Lange | |
| 2009/0200530 | A1 * | 8/2009 | Curchod | B63H 9/08 254/390 |

FOREIGN PATENT DOCUMENTS

| | | | |
|---|---|---|---|
| FR | 2 923 293 | A1 | 5/2009 |
| FR | 2 923 451 | A1 | 5/2009 |
| FR | 2 945 603 | A1 | 11/2010 |
| NL | 1036380 | C | 7/2010 |
| WO | 01/42682 | A | 6/2001 |
| WO | 2006/063387 | A | 6/2006 |
| WO | 2007/039684 | A1 | 4/2007 |

OTHER PUBLICATIONS

Statement by Estonian Maritime Museum in European Patent Application No. EP20140736748, dated Jul. 26, 2017.

"K-BLOCK User's guide. Karver Sailing Experience," Jan. 1, 2008, XP007905126 <http://www.jollespecialisten.com/PDF/K-Block.pdf>.

Relevance of the third-party observations submitted to the European Patent Office dated Jan. 3, 2018, Jan. 1, 2018 and Dec. 15, 2017, issued for European Patent Application No. EP 20140736748 dated Feb. 12, 2018.

A. Cort, "Low Friction Rings," Sail Magazine, Nov. 5, 2012 <https://www.sailmagazine.com/gear/low-friction-rings>.

Andy Schell, "Dynex Dux Across the Atlantic," Sail Magazine, Oct. 22, 2012.

Colligo Marine 2012-2013 Catalog, Rigging Reduced to it's Elegant Essentials, 2012 Colligo Magazine Marine, LLC.

Colligo Marine 2010 Marine Product Catalog, Bringing Innovative Solutions to the Marine Industry, 2009 Colligo Magazine Marine, LLC.

Third Party Observation for Application No. EP 20140736748 submitted to the European Patent Office dated Dec. 15, 2017.

Third Party Observation for Application No. EP 20140736748 submitted to the European Patent Office dated Jan. 3, 2018.

Third Party Observation for Application No. EP 20140736748 submitted to the European Patent Office dated Jan. 1, 2018.

* cited by examiner

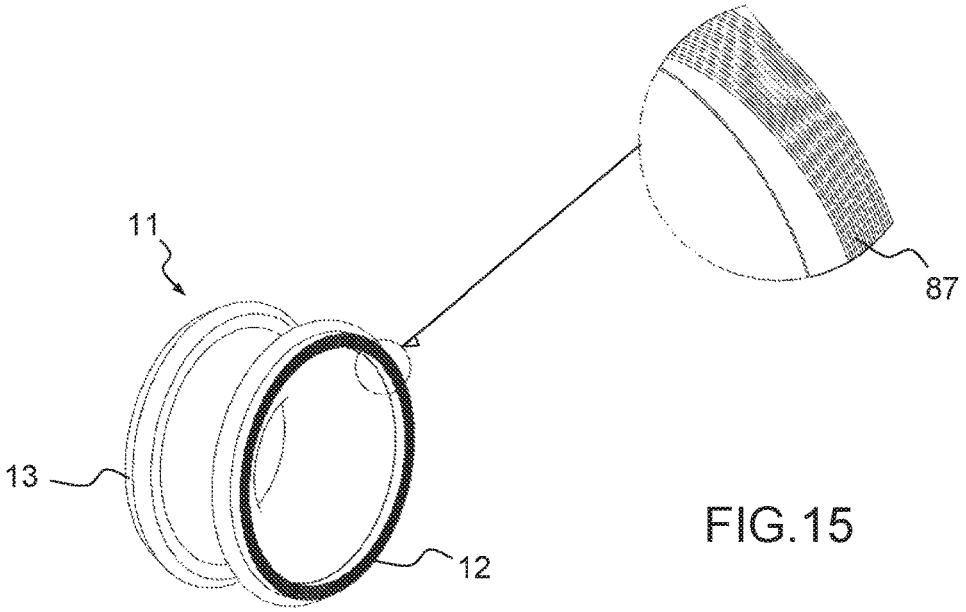
FIG.15
FIG.16
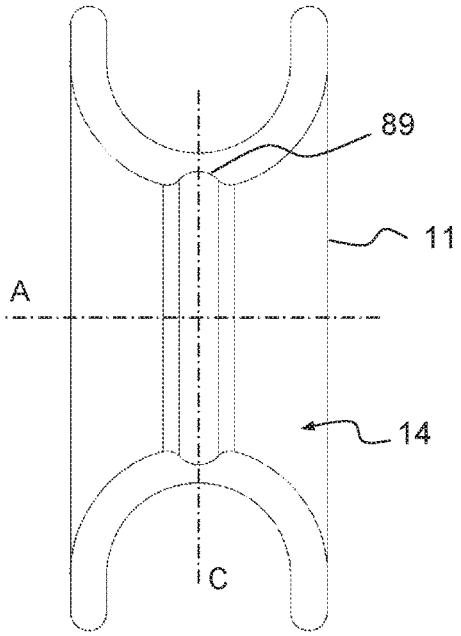

PULLEY

CROSS-REFERENCE TO RELATED APPLICATIONS

This application is a National Stage of International patent application PCT/EP2014/064202, filed on Jul. 3, 2014, which claims priority to foreign French patent application No. FR 1301574, filed on Jul. 3, 2013, the disclosures of which are incorporated by reference in their entirety.

FIELD OF THE INVENTION

The present invention relates to the field of pulleys, and more specifically pulleys which allow a rope to be redirected.

There exist on the market a plurality of types of pulley.

BACKGROUND

A first type of pulley is the sheave which allows a rope to be redirected when it passes through the central recess of the sheave (a pulley wheel having a groove).

Those low-friction sheaves provide a relationship of solidity/weight/price in all cases because there is no component in rotation. The resistance to friction is obtained only by the fiber of the rope to be redirected and the fiber which is used to fix the sheave. That product is increasingly present on ocean racing boats because it is a guarantee of reliability. The major disadvantage thereof is that it greatly increases the occurrences of friction of the rope which passes at the center thereof, and consequently it is necessary to have a great deal more energy in order to maneuver the rope than on a conventional pulley.

A second type of pulley comprises a ball bearing sheave, that is to say, a pulley with a sheave which rotates by means of a ball bearing. That ball bearing sheave provides a very small friction coefficient. That type of pulley is very efficient and allows the production of complex force step-down systems. The disadvantage of those pulleys is that they are expensive when they are provided for heavy loads. They also require maintenance and regular inspection owing to the presence of the ball bearing. Another disadvantage is that, if the axis, the lateral faces or the engagement location should break, then the connection will be broken between the rope and the engagement location and collateral damage will be brought about for the system as a whole. Furthermore, the performance of the ball-type pulleys which are configured for heavy loads are also heavy. For example, in the nautical field, that disadvantage is detrimental to the performance of a boat.

An object of the present invention is to overcome those disadvantages and to provide an improved pulley which reduces the occurrences of friction on the rope to be redirected whilst having a great load-bearing capacity, for a reduced weight.

SUMMARY OF THE INVENTION

The invention proposes a pulley comprising:

a monobloc sheave comprising two opposing longitudinal faces, a transverse central recess and a concave external surface forming an annular groove which is provided in order to redirect a rope, the central recess and the concave external surface being fixed relative to each other, a fixing rope of the sheave which extends through the central recess of the sheave, the fixing rope being in direct contact with the central recess, a spacer element which is arranged in order to space the fixing rope away from the longitudinal faces of the sheave.

The pulley allows the redirection of a rope (member which is long, flexible, resistant, round, composed of twisted threads) which extends through the annular groove of the sheave. The sheave is a wheel-like component which is used to transmit the movement. The sheave is maintained in position by the fixing rope of the sheave. The sheave rotates freely about the fixing rope and the spacer element is intended to space apart the rope in order to reduce the occurrences of friction of the fixing rope with the sheave.

In comparison with the pulley having a ball bearing of the prior art, the present pulley does not require any maintenance connected with the ball bearing. That advantage connected with the lightness, the price and the performance thereof as a result of the low friction makes the pulley of the present invention very advantageous.

This is because the pulley combines resistance, lightness, a modest price and in particular low friction. There results for the user a great increase in terms of ease of handling in relation to the use of a sheave when the rope is redirected by the central recess while having the lightness and the safety during use under heavy loads.

The spacer element serves to reduce the occurrences of friction on the sheave. That configuration allows the spacer element to rotate the sheave without being blocked by the compression of the fixing rope. Allowing the sheave to rotate about the fixing rope allows the occurrences of friction to be minimized.

The pulley according to the invention improves the safety of use thereof. For example, in the event of the sheave breaking, the redirected rope remains blocked by the fixing rope. Such a breakage may be the result of an overload on the redirected rope.

According to an aspect of the invention, the spacer element comprises two ends which project transversely relative to the longitudinal faces of the sheave, the two projecting ends being arranged in order to receive the fixing rope in abutment.

In this manner, the fixing rope is laterally spaced apart from the longitudinal faces of the sheave. In this manner, the fixing rope also serves to maintain the sheave in position in relation to the spacer element, which makes assembly easier because there are few components, and optimizes the assembly costs.

According to another aspect of the invention, the spacer element comprises two fixing means which are arranged at one side and the other of the longitudinal faces of the sheave, the fixing means being provided in order to fix the fixing rope to the spacer element.

According to another aspect of the invention, in a transverse plane which extends through the rotation axis of the sheave, the length of the spacer element, measured in accordance with a longitudinal axis of the spacer element parallel with the rotation axis, is greater than a distance which separates the longitudinal faces of the sheave, the distance being defined in accordance with the rotation axis of the sheave. In a specific embodiment, the length of the spacer element is a minimum of 1.5 times, and advantageously two times, the distance separating the longitudinal faces of the sheave.

The transverse plane of the pulley is defined when the sheave and the spacer element are assembled. The length of the spacer element is the distance between the two ends of the spacer element measured in accordance with a longitudinal axis in the transverse plane extending through the rotation axis.

Also according to the invention, the fixing rope moves away from the sheave in two directions, one at each side of the sheave, the two directions together forming an angle which is from 10° to 180°, and preferably from 80° to 120°. In this manner, the occurrences of friction are reduced. The angle is defined in the operating position of the pulley, that is to say, when the sheave is retained by the fixing rope.

According to another preference, the spacer element comprises an orientation groove of the sheave, the orientation groove being provided in order to cover at least a portion of the sheave.

In this manner, the orientation groove allows the sheave to be retained with friction in one direction, which prevents the sheave from pivoting or removing the spacer element during the loading. Furthermore, that configuration prevents the rope from being able to leave the sheave.

The fixing rope may comprise at least two strands which extend through the central recess of the sheave. Advantageously, the spacer element is arranged in order to space apart the two strands in a parallel manner with the longitudinal faces of the sheave. Alternatively, the at least two strands may be adjoining.

Preferably, the fixing rope of the sheave forms an endless loop. For example, the endless loop allows the spacer element to be maintained in relation to the sheave. This loop may be withdrawn from the spacer element in order to make assembly and disassembly of the pulley easier. The endless loop allows the sheave to be maintained and the sheave to be stabilized during loading. In this configuration, the spacer element is arranged in order to receive two cringles which are formed by the fixing rope at one side and the other of the central recess and in order to allow the pulley to be fixed by passing through the two cringles.

More generally, using the fixing rope in order to fix the pulley allows the safety during use thereof to be further improved. This is because, in the event of the spacer element breaking, the redirected rope remains blocked by the fixing rope.

According to another aspect of the invention, the pulley comprises a plurality of separate fixing ropes which each extend through the central recess. The pulley may comprise as many spacers as fixing ropes, each one associated with a fixing rope.

According to another aspect of the invention, the pulley comprises:

a plurality of monobloc sheaves each comprising two opposing longitudinal faces, a transverse central recess and a concave external surface forming an annular groove which is provided in order to redirect a rope, the central recess and the concave external surface being fixed relative to each other, a fixing rope which is associated with each of the sheaves and which extends through the central recess of the corresponding sheave, the fixing rope being in direct contact with the central recess of the sheave involved, a spacer element which is arranged in order to laterally move the different fixing ropes away from the longitudinal faces of the corresponding sheaves.

In order to improve the discharge of the heat generated by the friction of the fixing rope on the sheave, the sheave comprises a radiator which allows the heat generated by friction of the fixing rope in contact with the central recess to be dissipated by convection.

In order to limit the friction of the fixing rope on the sheave, the sheave comprises a cavity which is intended to receive a lubrication product and which is provided so as to lubricate the contact between the fixing rope and the central recess.

In order to facilitate the assembly of the pulley, the fixing rope comprises a closed loop which extends through the central recess and an extension which is intended to fix the pulley.

The pulley may comprise a becket which is formed by a rope loop which extends through the central recess and which is in direct contact with the central recess.

In an assembly of the fiddle block-type pulley, the pulley further comprises:

a second fixing rope of the sheave which extends through the central recess of the sheave and which is in direct contact with the central recess, a second monobloc sheave comprising two opposing longitudinal faces, a second transverse central recess, and a second concave external surface forming an annular groove which is provided in order to redirect a rope, the second central recess and the second concave external surface being fixed relative to each other, a second spacer element which is arranged in order to space the second fixing rope away from the longitudinal faces of the two sheaves.

Advantageously, the pulley comprises a means for detecting exceeding of an effort taken up by the fixing rope.

Advantageously, the pulley comprises a temperature measuring means.

BRIEF DESCRIPTION OF THE DRAWINGS

Other features and advantages of the invention will be appreciated in light of the following description, given on the basis of the appended drawings. Those examples are given in a non-limiting manner. The description should be read with reference to the appended drawings, in which:

FIGS. 14 and 15 illustrate sheaves which have heat discharge means, FIG. 16 illustrates a sheave which allows the lubrication of the contact with the fixing rope.

DETAILED DESCRIPTION

Figure 1:
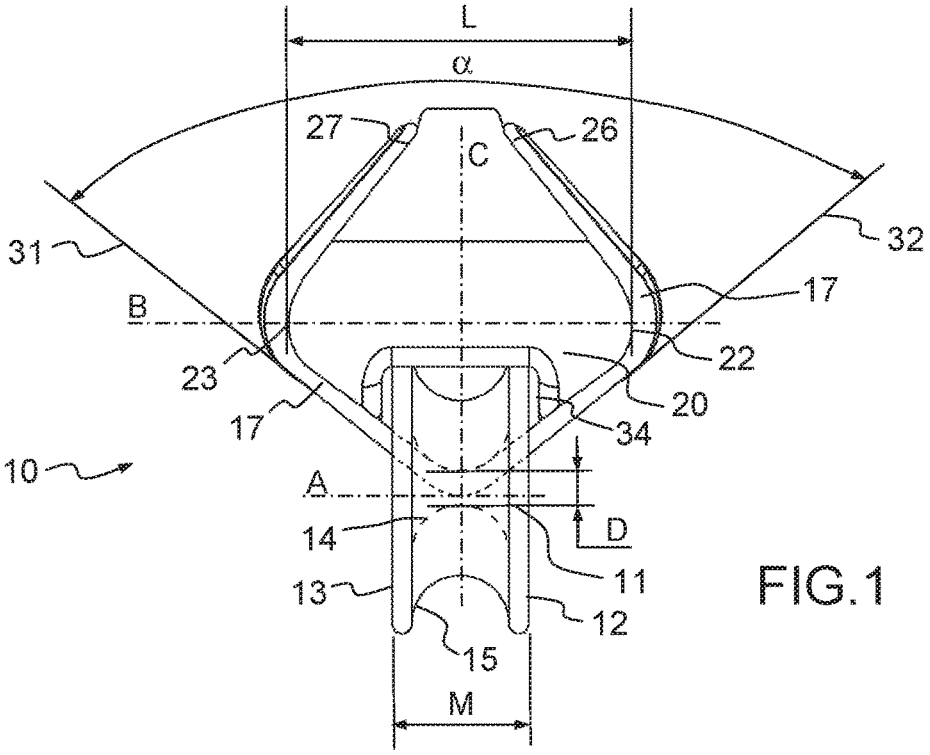
FIG. 1 is a front view of the present invention according to a first embodiment.
Figure 2:
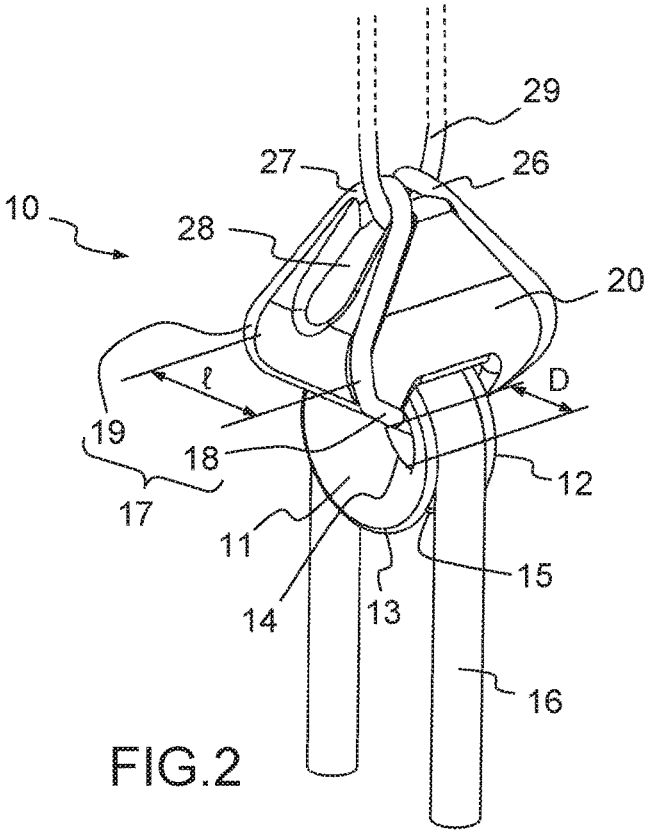
FIG. 2 is a perspective view of the invention according to a first embodiment.

FIGS. 1 and 2 show a first embodiment of a pulley 10 according to the invention. The pulley 10 comprises a sheave 11 comprising two opposing longitudinal faces 12 and 13, a transverse central recess 14 and a concave external surface 15 forming an annular groove which is provided to redirect a rope 16. The central recess 14 extends through the sheave 11 from one longitudinal face to the other. The sheave 11 is monobloc. In other words, the two longitudinal faces 12 and 13, the central recess 14 and the concave external surface 15 are fixed to each other. The sheave 11 may be produced in a single mechanical piece, for example, produced by molding or machining. Alternatively, the sheave 11 may comprise a plurality of mechanical components which are produced separately and subsequently assembled in order to form an assembly in which the functional surfaces 12, 13, 14 and 15 are all fixed relative to each other.

The sheave 11 may rotate about itself about an axis A which is perpendicular to the two longitudinal faces 12 and 13. The sheave 11 is generated by revolution about the axis A. The pulley 10 also comprises a fixing rope 17 of the sheave 11. A portion of the fixing rope 17 extends through the central recess 14 of the sheave 11. The fixing rope 17 extends, in the central recess 14, substantially in accordance with the axis A. The fixing rope 17 may have a single strand. Alternatively, the fixing rope 17 may have multiple strands. In the example illustrated, the fixing rope 17 comprises two strands 18 and 19 which extend at one side and the other of the two longitudinal faces 12 and 13 of the sheave 11.

The pulley 10 comprises a spacer element 20 which is arranged to laterally space the fixing rope 17 away from the longitudinal faces 12 and 13 of the sheave 11. When the sheave 11 rotates, it rubs on the fixing rope 17. The presence of the spacer element 20 allows that friction to be reduced.

The spacer element 20 comprises two ends 22 and 23 which project transversely relative to the longitudinal faces 12 and 13 of the sheave 11. The two ends 22 and 23 are arranged to receive in abutment the two strands 18 and 19 of the fixing rope 17. In this manner, the two strands 18 and 19 retain the sheave 11 while reducing the occurrences of friction during use of the pulley 10. A length L of the spacer element 20 is the distance between the two ends 22 and 23 of the spacer element 20 in accordance with a longitudinal axis B parallel with the rotation axis A of the sheave 11. In order to space the fixing rope 17 away from the longitudinal faces 12 and 13 of the sheave 11, the length L is greater than a distance M which separates the longitudinal faces 12 and 13. The distance M is defined in accordance with the axis A.

Producing the fixing rope 17 in at least two strands limits any defects in terms of parallelism of the two axes A and B. This is because the direction of the efforts applied to the sheave 11 by the rope 16 may vary, bringing about a rotation of the sheave 11 relative to the spacer 20 about an axis C which is perpendicular to the two axes A and B. A width I of the spacer element 20 is a distance which is perpendicular to the length L and which separates for each end 22 and 23 the abutments of the two strands 18 and 19 against the spacer element 20. The width I limits the rotation of the sheave 11 relative to the spacer element 20 about the axis C. The width I is advantageously greater than the smallest diameter D of the central recess 14. The central recess 14 is generated by revolution about the axis A. The diameter thereof perpendicularly to the axis A may be variable, in order to obtain, for example, a type of "diabolo" which extends around the axis A. The smallest diameter D of the central recess 14 is then present in the region of the axis C. Other forms of the central recess 14 are possible. The central recess 14 may have a cylindrical form with a constant circular cross-section, an ovoid form, a hyperboloid form generated by revolution, etc.

In other words, the spacer element 20 is arranged to space apart the two strands 18 and 19 parallel with the longitudinal faces 12 and 13 of the sheave 11.

The two strands 18 and 19 may be completely separate. Alternatively, in the embodiment illustrated in FIGS. 1 and 2, the fixing rope 17 of the sheave 11 forms an endless loop, and the sheave 11 is then retained by the fixing rope 17 at a plurality of locations which follow the form of the spacer element 20. The two strands 18 and 19 of the fixing rope 17 are defined between the portions of the fixing rope 17 at one side and the other of the sheave 11 between the two longitudinal faces 12 and 13 of the sheave 11 and the spacer element 20. The endless loop is fixed to the spacer element 20 in a groove or a recess, the form of which substantially corresponds to that of the strands 18 and 19. For example, for strands 18 and 19 having a circular cross-section, the grooves which are intended to receive the strands 18 and 19 also have cross-sections which are substantially semi-circular and of the same diameter as the cross-section of the strands 18 and 19. In this manner, the fixing rope 17 is fixed in position in relation to the spacer element 20.

In the variant in which the fixing rope 17 of the sheave 11 forms an endless loop, the fixing rope 17 is closed on itself by means of two cringles 26 and 27 which are formed by the fixing rope 17 and which are arranged at one side and the other of the central recess 14.

The spacer element 20 is arranged to receive the two cringles 26 and 27 and to allow fixing of the pulley 10 extending through the two cringles 26 and 27. To this end, the spacer element 20 comprises an opening 28 which allows an external element to extend through the two cringles 26 and 27. In the example illustrated, that external element is a rope 29 which allows the pulley 10 to be fixed.

The fixing rope 17 moves away from the sheave 11 in accordance with two directions 31 and 32, one at each side of the sheave 11. The two directions 31 and 32 together form an angle $\alpha$ from 10° to 180° and preferably from 80° to 120°. That angle $\alpha$ is defined mainly by the form of the spacer element 20 and may vary slightly in accordance with the efforts applied to the rope 16. In the example illustrated in FIG. 1, the angle $\alpha$ is 100°.

The spacer element 20 may also comprise an orientation groove 34 of the sheave 11. The orientation groove 34 opens in accordance with the axis C. The orientation groove 34 is provided to cover at least a portion of the sheave 11. That distinctive feature prevents the sheave 11 from leaving the position thereof or the rope 16 to be redirected from leaving the groove 15 of the sheave 11.

Figure 3:
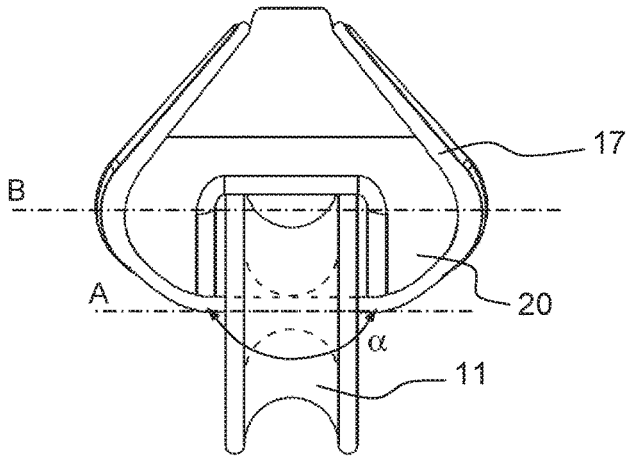
FIG. 3 is a front view of the present invention according to a variant of the first embodiment.

FIG. 3 shows a variant of the first embodiment; there are shown the same elements as in the first embodiment. The difference is that the spacer element 20 covers the sheave 11 so that the fixing rope 17 moves away from the sheave 11 in accordance with the same axis. In other words, the angle $\alpha$ is 180°. Subsequently, the fixing rope 2 follows the form of the spacer element 20.

Figure 4A:
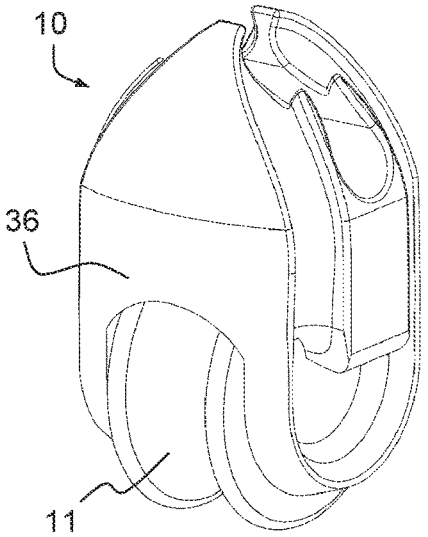
FIGS. 4*a* and 4*b* illustrate a variant of the first embodiment.
Figure 4B:
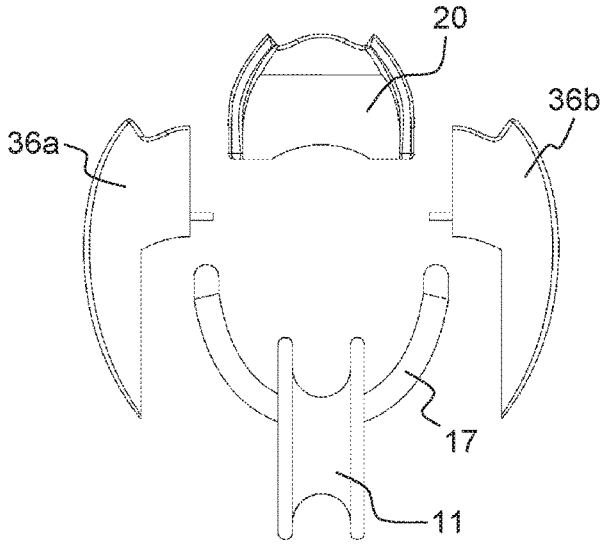

FIGS. 4*a* and 4*b* illustrate another variant of the pulley 10 comprising a cap 36 which allows the fixing rope 17 to be protected. The pulley is illustrated as a perspective view in FIG. 4*a* and as an exploded view in FIG. 4*b*. The cap 36 may be formed in two portions 36*a* and 36*b*.

Figure 5:
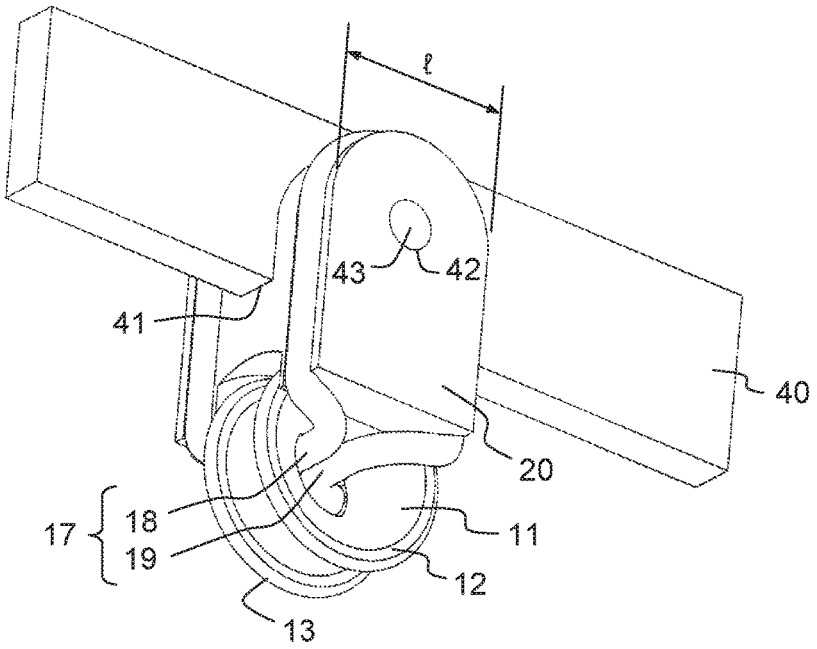
FIG. 5 illustrates another variant of the first embodiment.

FIG. 5 further illustrates another variant of the pulley 10 in which the fixing of the pulley is adapted to a rigid object 40. There are shown the sheave 11, the spacer element 20 and the fixing rope 17 which is formed here by the two strands 18 and 19. In this variant, the spacer element 20 has a groove 41 which opens parallel with the two longitudinal faces 12 and 13 of the sheave 11. The groove 41 opens between the two cringles 26 and 27. The spacer element 20 comprises a bore 42 which is perpendicular to the groove 41. The groove 41 is intended to receive the rigid object 40 and the bore 42 is intended to receive an axle 43 which extends through both the spacer element 20 and the rigid object 40. The axle 43 may be a screw which allows the spacer element 20 to be connected to the rigid object 40. The dimensions of the groove 41 and those of the rigid element 40 may be adapted so as to define a precise position of the spacer element 20 on the rigid object 40.

FIG. 5 clearly shows the width I of the spacer element 20 which allows an improvement of the fixing in position of the sheave 11 in relation to the spacer element 20. That fixing in position is particularly advantageous in this variant. It simultaneously allows an improvement of the fixing in position of the sheave 11 in relation to the rigid object 40 by means of the spacer element 20.

Figure 6:
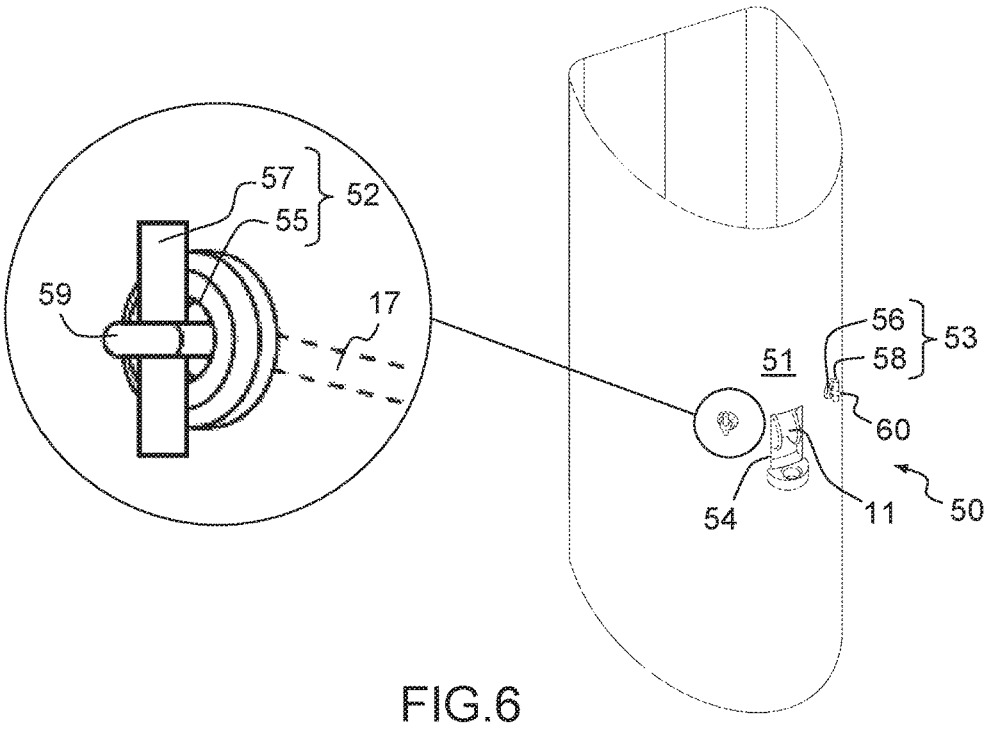
FIGS. 6 and 7 illustrate an embodiment in which the spacer element forms a structure having other functions.
Figure 7:
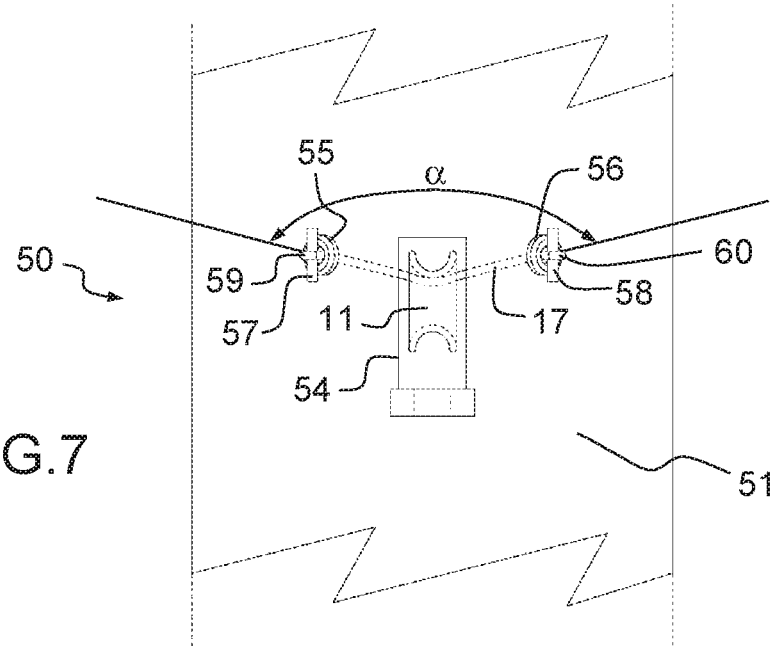

FIGS. 6 and 7 show a second embodiment. In the same manner as the first embodiment, the pulley 50 comprises a sheave 11 comprising two opposing longitudinal faces 12 and 13, a transverse central recess 14 and a concave external surface 15 forming an annular groove which is provided in order to redirect a rope. The pulley 50 also comprises a fixing rope 17 of the sheave 11. A portion of the fixing rope 17 extends through the central recess 14 of the sheave 11. The fixing rope 17 may comprise two strands which extend at one side and the other of the two longitudinal faces 12 and 13 of the sheave 11.

The pulley 50 also comprises a spacer element 51 comprising two fixing means 52 and 53 which are arranged at one side and the other of the longitudinal faces of the sheave 11. The fixing means are provided in order to fix the fixing rope 17 of the sheave 11 to the spacer element 51. In this manner, the fixing rope 17 allows the fixing rope 17 to be spaced laterally away from the longitudinal faces 12 and 13 of the sheave 11 and thus the angle $\alpha$ to be increased. The greater the angle $\alpha$ becomes, the more the occurrences of friction are reduced.

The spacer element 51 may be produced in a structure which can serve other functions. In the example illustrated in FIGS. 6 and 7, the spacer element 51 is produced in a boat mast. Such a mast may be formed in a hollow metal profile-member. A first opening 54 is produced in the profile-member in order to place the sheave 11 therein. Two other openings 55 and 56 are produced in the profile-member in a symmetrical manner with respect to the opening 54. The two openings 55 and 56 each allow one end of the fixing rope 17 to be fixed. More specifically, the ends of the fixing rope 17 each extend through one of the openings 55 and 56 and a retention element 57 and 58, respectively, which is attached to each end allows each end of the fixing rope 17 to be retained. The fixing means 52 and 53 comprise the openings 55 and 56 and the retention elements 57 and 58. A boat mast generally has a convex profile. The fixing rope 17 can thus be mainly arranged inside the profile-member. The ends of the fixing rope 17 which are provided with the retention elements 57 and 58 extend outside the mast. The pulley 50 can be used to guide a rope 16 extending through the wall of the mast, for example, for a halyard, allowing a sail to be hoisted. The halyard extends inside the mast and, at the bottom of the mast, the halyard extends out of the mast in order to be able be maneuvered. The pulley 50 allows the halyard to leave the mast and allows it to be redirected for the maneuver thereof. The fixing rope 17 may be an endless loop, and the ends of the fixing rope 17 extending out via the openings 55 and 56 may be cringles 59 and 60 which are formed in the fixing rope 17. The retention elements 57 and 58 may be fingers which are slipped into the cringles 59 and 60. Alternatively, it is possible to have a hook, to which each end of the fixing rope 17 is fixedly joined or any other means which allows the strands or the ends of the fixing rope 17 to be fixedly joined to the spacer element 51 so as to fix the sheave 11 in position. The pulley 50 has been described by means of a mast from which it is desirable to cause a rope 16, such as a halyard, to extend. Naturally, it is possible to use this variant for any type of wall, through which a rope 16 extends, the wall being provided with a pulley on which the rope 16 is supported in order to extend through the wall.

Figure 8:
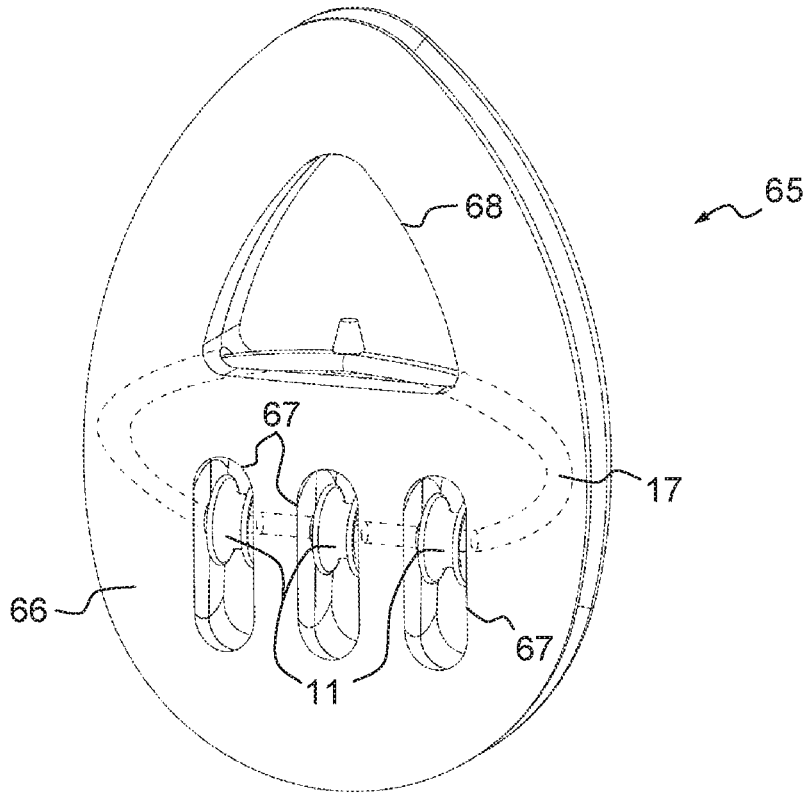
FIG. 8 illustrates an embodiment in which a plurality of sheaves share the same spacer element.

FIG. 8 illustrates a third embodiment of a pulley 65 comprising three sheaves 11 which are arranged parallel with each other in accordance with the same rotation axis of the sheaves 11. Each sheave 11 is identical to the description of the first embodiment or second embodiment.

The pulley 65 also comprises a spacer element 66 comprising three grooves 67 in each of which one of the sheaves 11 may slide. The spacer element 66 is common to the different sheaves 11.

A fixing rope 17 extends through the central recess 14 of each sheave 11, passing through each of the grooves 67. As above, the fixing rope 17 extends at one side and the other of the two longitudinal faces 12 and 13 of each sheave 11. In the configuration illustrated, the fixing rope 17 forms an endless loop. The spacer element 66 comprises an opening 68 which allows the pulley 65 to be fixed.

That third embodiment may naturally be applied whatever the number of sheaves 11.

Figure 9:
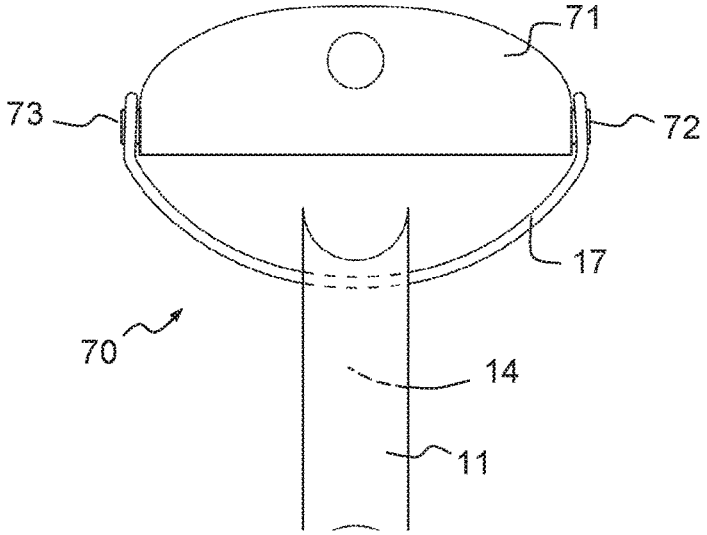
FIG. 9 illustrates an embodiment in which the spacer element is stiffened.

FIG. 9 schematically illustrates another embodiment in which the spacer element 71 of a pulley 70 is formed by an element comprising two ends 72 and 73 which project transversely relative to the longitudinal faces 12 and 13 of the sheave 11. The two ends 72 and 73 are arranged in order to fix the ends of the fixing rope 17. In order to best withstand the efforts generated by the fixing rope 17 on the spacer element 71, the spacer element may be metallic.

Figure 10:
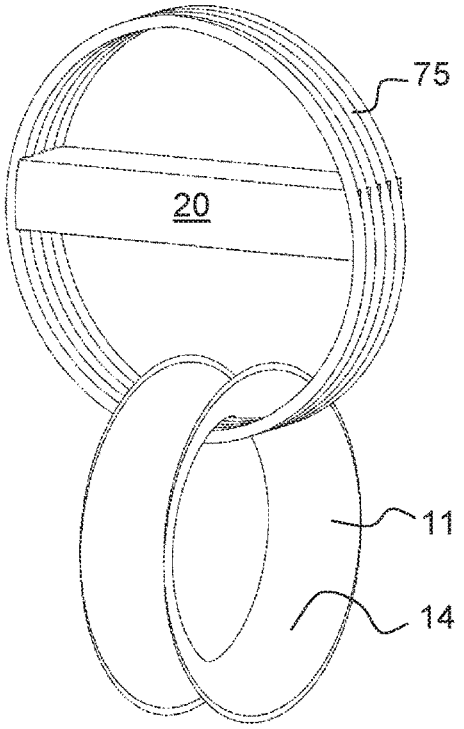
FIG. 10 illustrates an embodiment in which the fixing rope is produced by filament winding.

FIG. 10 schematically illustrates an embodiment in which a fixing rope 75 comprises a plurality of smaller loops in order to have the same load support as with a fixing rope 17 having a greater diameter. It is possible to produce a fixing rope 75 by filament winding. The number of loops produced is in accordance with the effort which the pulley has to support.

Figure 11:
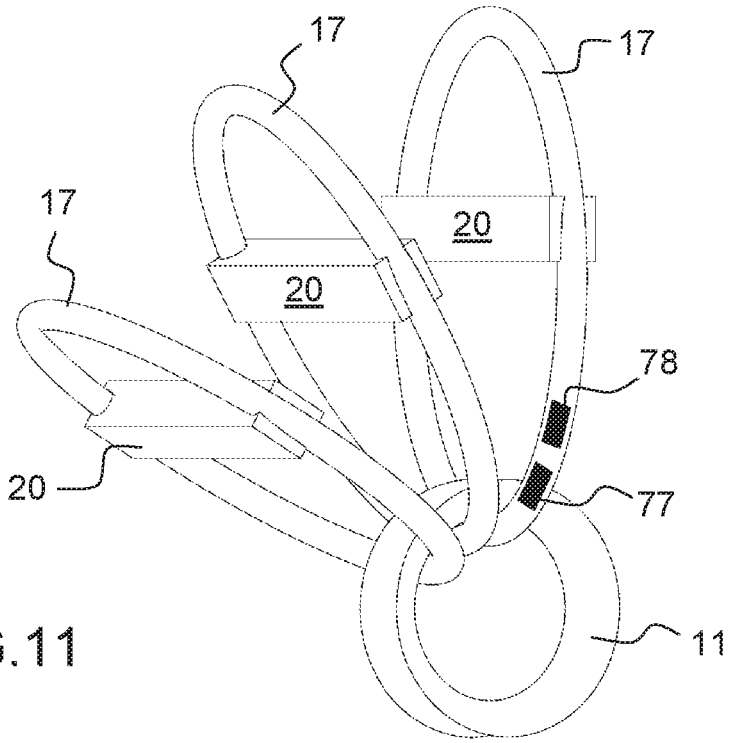
FIGS. 11 and 12 illustrate two embodiments in which a plurality of fixing rope loops are associated with the same sheave.
Figure 12:
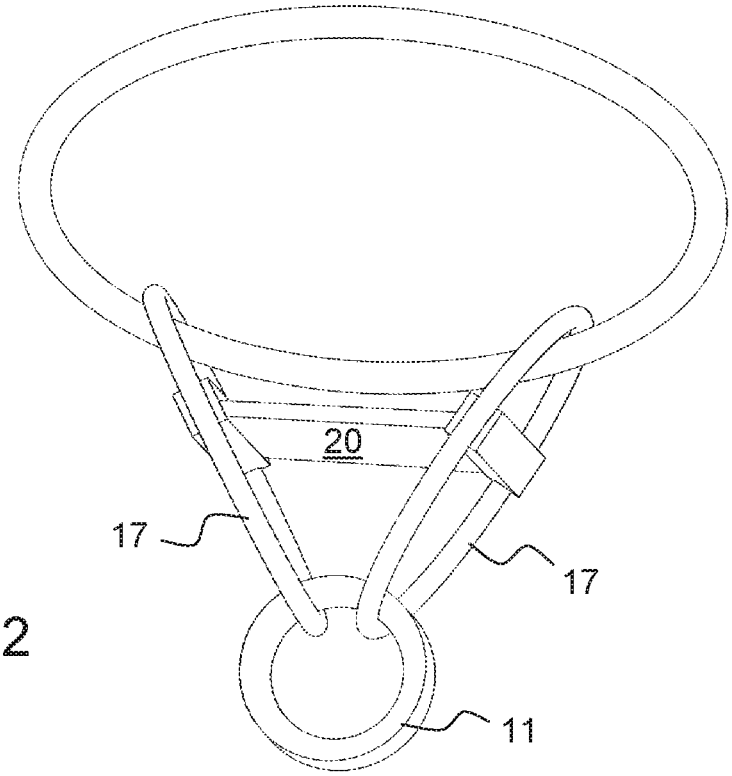

According to two other embodiments, which are illustrated in FIGS. 11 and 12, it is possible to have a plurality of endless loops of fixing rope 17 in order to allow greater loads to be supported than with a single fixing rope 17. The fixing rope 17 can also be composed of a plurality of strands which are fixed to each other. In FIG. 11, there is associated with each loop of fixing rope 17 a spacer element 20. In FIG. 12, a spacer element 20 is common to a plurality of loops of fixing rope 17.

The two embodiments of FIGS. 11 and 12 may allow the production of a means for detecting exceeding of an effort taken up by the fixing rope 17. For example, it is possible to provide that one of the fixing ropes 17 associated with the same sheave 11 has a mechanical strength smaller than another fixing rope 17. That weaker strength may be obtained by a smaller cross-section of the fixing rope or by a material whose mechanical strength is weaker. A maximum nominal effort which the pulley can take up may be defined by the rupture strength of the fixing rope 17 having the weakest mechanical strength. If this effort is exceeded, the fixing rope 17 having the weakest mechanical strength breaks and the other fixing rope(s) 17 take over in order to ensure the continuity of service of the pulley. The breakage of one of the fixing ropes 17 allows visual detection of the nominal effort being exceeded and allows a warning that a change of pulley is necessary.

Alternatively, other means for detecting exceeding of an effort may be used in a pulley according to the invention, such as, for example, with the positioning of one or more deformation gauges 77 on the fixing rope 17, which gauges are formed, for example, by a resistive element whose resistance develops with the extension thereof. The fixing rope 17 being fixed relative to the fixing of the pulley, it is simple to electrically connect the deformation gauge 77 to measuring means external with respect to the pulley by following the fixing rope 17 and fixing the pulley in order to measure the resistance thereof and consequently to determine the effort taken up by the fixing rope 17.

Figure 13:
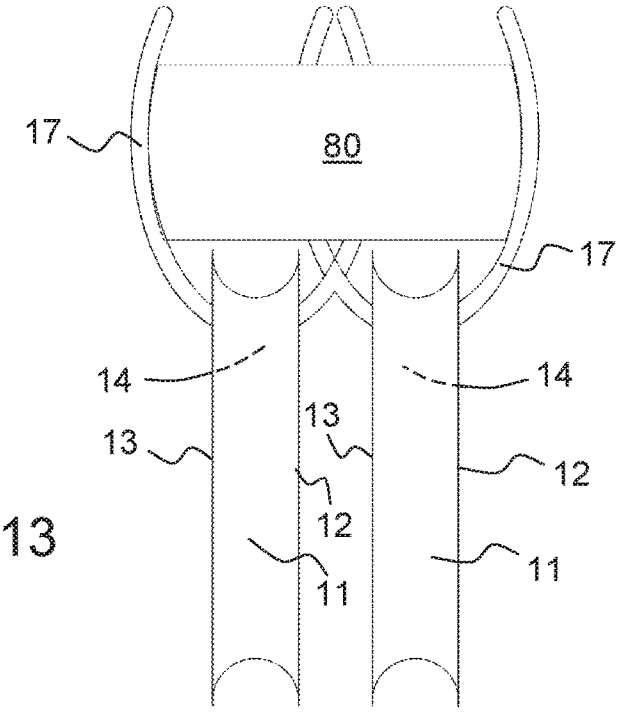
FIG. 13 illustrates an embodiment in which the same spacer element is associated with a plurality of sheaves.

FIG. 13 illustrates an embodiment in which the same spacer element 80 is associated with a plurality of sheaves 11. Each sheave 11 has an individual fixing rope 17. The different fixing ropes 17 are all retained by the same spacer element 80. In the example illustrated, the rotation axes of each sheave 11 are parallel with each other or even common. It is also possible to provide the sheaves 11 so that the rotation axes of the different sheaves are not parallel with each other in order to have pulleys which have a diverse range of uses.

Figure 14:
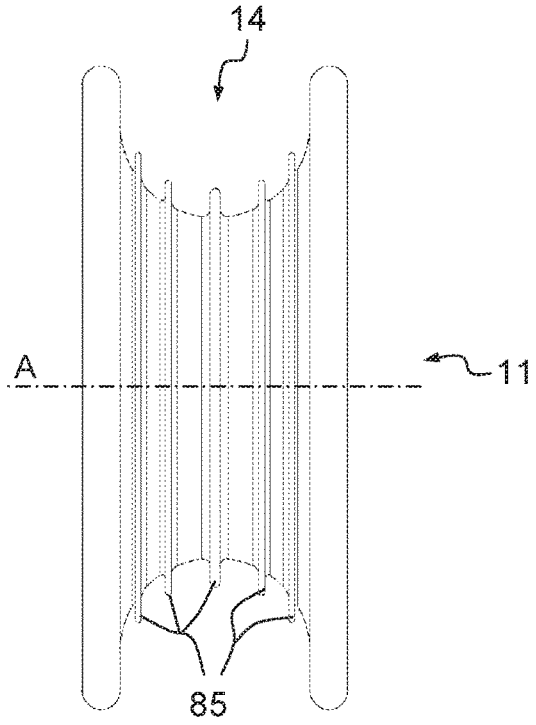

FIGS. 14 and 15 illustrate sheaves 11 which have heat discharge means. This is because, during operation, when the sheave 11 rotates, the friction between the fixing rope 17 and the sheave 11 generates heat and advantageously the sheave 11 comprises a radiator which allows dissipation by convection of the heat generated by the friction of the fixing rope 17 in contact with the central recess 14. In FIG. 14, fins 85 which form a radiator are arranged in the annular groove 15. The fins 85 extend, for example, perpendicularly to the axis A. In FIG. 15, fins 87 are arranged on one or on both longitudinal faces 12 and 13. The spacer element 20, which is not illustrated in FIG. 15, advantageously prevents contact between the fixing rope 17 and the fins 87.

FIG. 16 illustrates a sheave 11 which allows lubrication of the contact with the fixing rope 17. That lubrication allows a limitation of the heating in the region of the contact between the fixing rope 17 and the central recess 14. The lubrication may be brought about simply by placing a lubrication product, such as a grease, on the fixing rope 17. This requires regular interventions in order to re-coat the fixing rope 17 with grease. In order to space out those interventions, it is possible to provide in the pulley a lubrication reservoir. To this end, the sheave 11 comprises a cavity 90 which is intended to receive a lubrication product. The cavity 90 is arranged so as to lubricate the contact between the fixing rope 17 and the central recess 14. The cavity 90 is, for example, arranged on the axis C.

More generally, the pulley comprises discharge means for the heat generated by the friction of the fixing rope 17 in contact with the central recess 14. Those means may be arranged in the sheave 11, as illustrated in FIGS. 14 and 15, or alternatively in the spacer 20 or in the fixing rope 17, for example, by means of a channel extending in the fixing rope 17, the channel being intended to convey a heat exchange fluid which allows the heat to be discharged.

The lubrication and heat exchange toward the outer side allow the heating of the pulley to be limited. The pulley may also comprise a temperature measuring means, for example, located in the fixing rope 17. As for the effort sensor, it is possible to place in the fixing rope 17 a temperature sensor 78, for example, using a resistor having a temperature coefficient which is positive or negative. It is also possible to place on the fixing rope an element which is capable of changing color when a temperature threshold is exceeded. The change in color may be definitive in order to allow a recording of the threshold being exceeded in order to warn that a change of pulley is necessary.

FIGS. 17 to 20 illustrate different assemblies of a pulley according to the invention. Each assembly is described with reference to an embodiment which is particularly suitable therefor. It is self-evident that the different assemblies described may be used for the other embodiments. Simple adaptations of the assemblies are then intended to be carried out.

Figure 17:
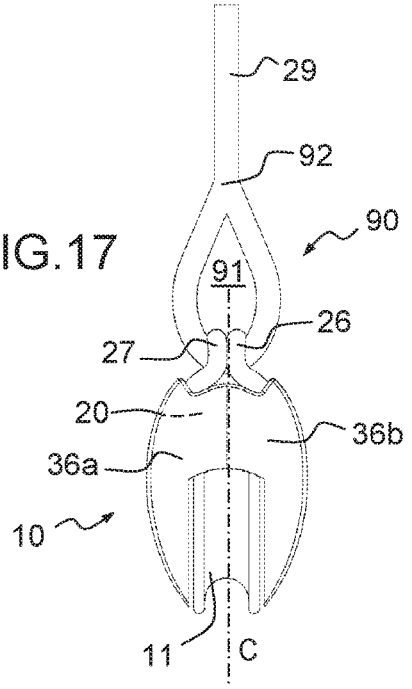
FIGS. 17 to 20 illustrate different assemblies of a pulley according to the invention.

FIG. 17 takes up the embodiment illustrated in FIGS. 4*a* and 4*b*. The spacer element 20 is hidden under the two portions 36*a* and 36*b* of the cap. The fixing rope 17 forms an endless loop and two cringles 26 and 27 extend out of the cap 36 in the region of the axis C. One end 90 of the rope 29 extends through the two cringles 26 and 27 in order to fix the pulley 10. The end 29 forms a closed loop 91. It is possible to re-close the loop 91 by means of a knot which is produced at the end 90 of the rope 29. Advantageously, the loop 91 is re-closed by means of a splice produced on the rope 29.

Figure 18:
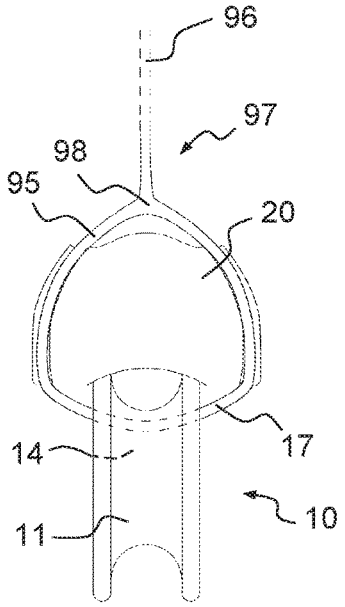

FIG. 18 illustrates an assembly variant of the pulley 10 in which the fixing rope 17 comprises a closed loop 95 which extends through the central recess 14 and an extension 96 which is intended to fix the pulley 10. More specifically, the same rope is used as a fixing rope extending through the sheave 11 and as the means for fixing the pulley 10. It is possible to carry out this assembly by passing through the sheave 11 one end 97 of the rope. The end 97 is brought into abutment with the spacer element 20 and then re-closed, for example, by means of a splice 98. At the outer side of the closed loop 95 which is formed by the splice 98, the rope extends in order to form the extension 96 allowing the pulley 10 to be fixed.

Figure 19:
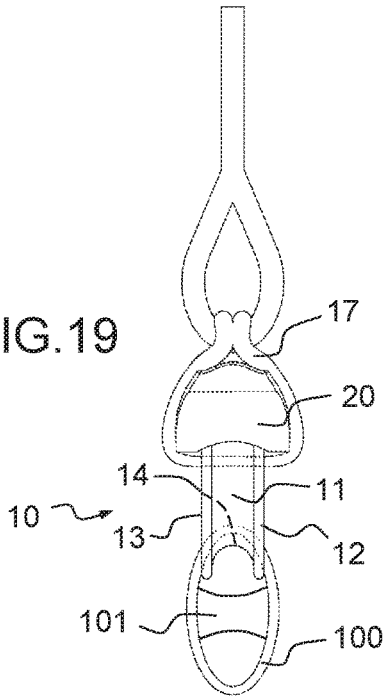

FIG. 19 illustrates an assembly variant of the pulley 10 in which a becket 100 is formed by a rope loop which extends through the central recess 14 and which is in direct contact with the central recess 14. In the example illustrated, the becket 100 is formed by a rope loop which is separate from the fixing rope 17. Alternatively, the fixing rope 17 can be extended in order to form the becket 100.

The fixing of the pulley 10 is, in the example illustrated, similar to the fixing described with reference to FIG. 17. The becket 100 added particularly allows the production of a fixed point for a rope 16, not illustrated in FIG. 19. That fixed point can be used in a hoist using the pulley 10. The becket 100 is separate from the fixing rope 17. The presence of a becket 100 is illustrated here in a simplified manner. It is possible to place in the loop produced by the becket 100 a spacer element 101 which is arranged to move the becket 100 away from the longitudinal faces 12 and 13 of the sheave 11.

Alternatively, a becket may be formed by a rope loop which is fixed to the spacer element 20 and which is independent of the sheave 11.

Figure 20:
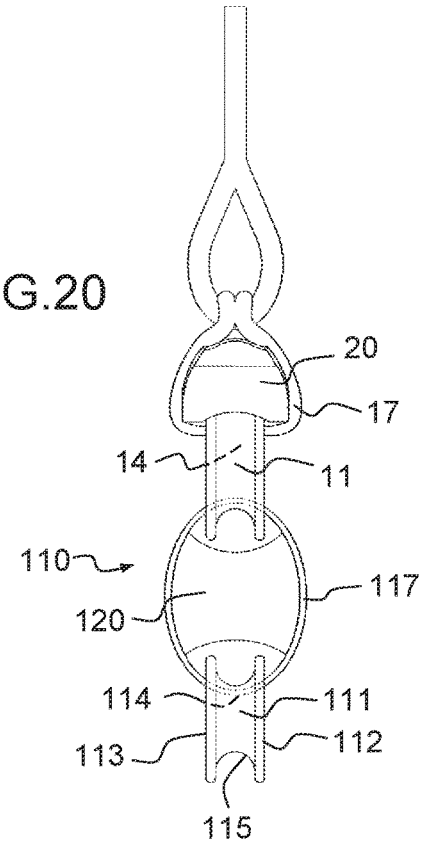

FIG. 20 illustrates an assembly variant of the pulley 10 which is very suitable for producing a hoist. A common assembly referred to as a "fiddle pulley" involves an assembly which is formed by two sheaves which are mounted on the same carrying structure. This assembly is adapted to the invention here. The fiddle pulley according to the invention is designated 110. More specifically, the pulley 110 comprises as above a first sheave 11, a first spacer element 20 and a first fixing rope 17 whose features have been described above. The pulley 110 further comprises:

a second fixing rope 117 of the first sheave 11 which extends through the central recess 14 of the sheave 11 and which is in direct contact with the central recess 14, a second monobloc sheave 111 which is similar to the sheave 11 and which comprises two opposing longitudinal faces 112 and 113, a second transverse central recess 114, and a second concave external surface 115 forming an annular groove which is provided to redirect a rope, the second central recess 114 and the second concave external surface 115 being fixed relative to each other, a second spacer element 120 which is arranged to move the second fixing rope 117 away from the longitudinal faces 12, 13, 112 and 113 of the two sheaves 11 and 111.

According to all the embodiments, the sheave 11 advantageously has an appearance which is as smooth as possible and must not become deformed under stress. Consequently, the possible materials are limited, and they are mainly metals or composite materials.

For example, here is a non-exhaustive list of metals and composite materials which are possible:

aluminum, pure or anodized and the derivatives thereof; stainless steel, natural or polished; titanium which may or may not be processed; cast aluminum, etc.

isotropic composite materials based on plastics injection molding, which may or may not be charged with fiber (polyamide, polyethylene, polyester, polyurethane, etc.); anisotropic composite materials based on resins (epoxy, polyester, vinyl ester, natural) and fibers (carbon, glass, kevlar, flax, cellulose), etc.

Those two examples are not exhaustive and all comprise metals or composite materials which are advantageously both light and resistant to corrosion and ultraviolet light, while having a high level of resistance to stress. There can be used metal alloys, charged metals and composite materials of carbon or glass fiber type.

Similarly, according to all the embodiments, the spacer element 20 is not subjected to high compression, therefore the materials which will be used for constructing it may be the same as for the sheave 11, with in addition the materials produced from molding or plastics injection molding. It is even possible to produce the spacer element 20 from wood.

According to all the embodiments, the fixing rope 17 is advantageously a textile which ensures the connection between the sheave 11 and the spacer element 20. Firstly, the material must have a high level of tensile strength and be suitable for the operating load of the pulley. Subsequently, the mechanical characteristics thereof under occurrences of friction must be excellent. Few fibers comply with those two conditions, but it is possible to mix the fibers with each other. That is the reason for there being a large number of possible materials which can be used.

For example, the fixing rope 17 is produced from a single material, such as high-modulus polyethylene (or commonly referred to as "Dyneema®" or "Spectra®", and referred to below as dyneema), high-performance polyethylene, or a sub-assembly of polyethylene. That material combines lightness, tensile strength, weak extension, resistance to external aggressions (chemical, organic, ultraviolet), a low friction coefficient and a reasonable cost. Advantageously, using a single material provides the best combination of efficiency, quality and price.

Figure 21:
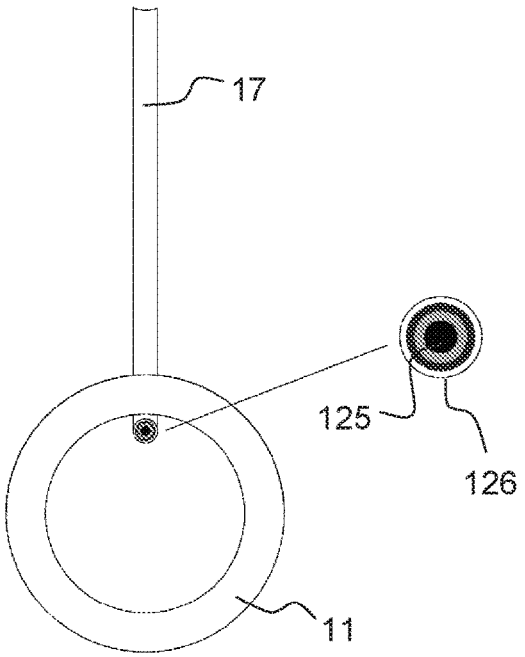
FIG. 21 illustrates a pulley in which the fixing rope is composite.

In another example as, for example, illustrated in FIG. 21, there is used an admixture of a plurality of materials comprising, for example, an internal structural portion is referred to as the core 125 and a protective portion is referred to as the cover 126. The core 125 may be a fiber which is very resistant to tension and, for the cover 126, it is possible to use a fiber having a low friction coefficient. Here are a number of possible examples:

- core of dyneema, cover of dyneema or dyneema/teflon admixture,
- core of aramide, cover of dyneema or dyneema/teflon admixture,
- core of vectran, cover of dyneema or dyneema/teflon admixture,
- core of PBO (poly-p-phenylene benzobisoxazole), cover of dyneema or dyneema/teflon admixture,
- core of pre-drawn polyester, cover of dyneema or dyneema/teflon admixture,
- core formed by a metal braid and cover of dyneema.

However, the admixture of a plurality of fibers is not preferred, given that performance levels and the durability over time are reduced.

The core 125 may also have a treatment such as polyurethane or a sub-assembly of polyurethane.

The cover 126 may be formed from a self-lubricating material in order to limit the occurrences of friction between the sheave 11 and the fixing rope 17.

Figure 22:
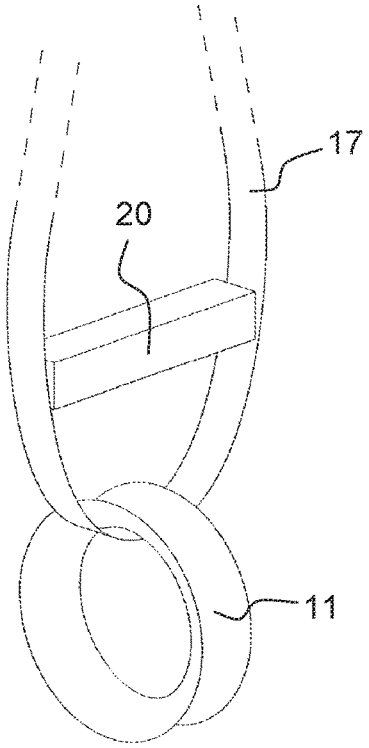
FIG. 22 illustrates a pulley in which the fixing rope is formed by means of a strap.

FIG. 22 illustrates a variant of a pulley in which the fixing rope 17 is formed using a strap which can be produced using flat woven fibers. The fibers used comprise, for example, high-modulus polyethylene, as described above, or any other material which is suitable for supporting friction against the sheave 11.

In all the other Figures, the cross-section of the fixing rope 17 is circular. Naturally, any other cross-section of the fixing rope 17 is possible without departing from the scope of the invention.

In order to demonstrate the surprising result of the load resistance of the present invention, the pulley of the present invention is compared with two solutions. The first solution is a sheave alone and the second solution is a ball-type sheave, that is to say that it has a ball bearing. The sheave used weighs 12.8 grams for a working load of 1600 kilos and a breaking load at 3500 kilos. The ball-type sheave weighs 118 grams for a working load of 500 kilos and a breaking load at 1500 kilos.

In order to carry out the tests, two force sensors are used: the first force sensor 135 has a capacity of 10 tonnes and the second force sensor 136 has a capacity of 5 tonnes. The two force sensors have been mounted in series in order to measure the error load. The margin of error is 0.5% between the two force sensors.

The test relates to the capacity of the redirection element 138 to be tested (the pulley of the present invention, the sheave and the ball-type sheave) and to transmit the load of a traction force which is applied by a hydraulic cylinder 134 which is connected by a rope to a fixed point 137. For the pulley according to the present invention, the fixing rope 17 is composed of a core of high-modulus polyethylene and a cover of polyester having a diameter of 6 mm. The angle formed by the rope extending into the redirecting element 138 is 180°.

Figure 23:
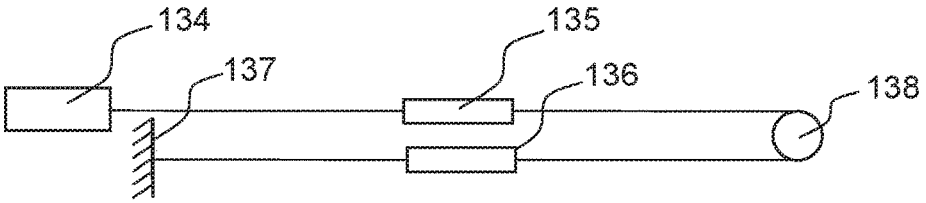
FIG. 23 is a schematic test view of the present invention.

The first force sensor 135 is installed on the load line of the hydraulic cylinder 134, the second force sensor 136 is installed on the rope which is engaged at the fixed point 137. The elements are connected to each other by bowline knots. The configuration of the test can be seen in FIG. 23.

The first test involved testing a sheave alone having a diameter of 35 mm. A dyneema rope extends through the central recess and retains the sheave in an integral manner. The load line of the test also extends through the central recess of the sheave. During the tensioning, it was noticed that the rope slid jerkily and emitted a noise which is characteristic of a high level of friction force.

Table of results with one of the measurements obtained by the force sensors:

| Measurement of the load between actuator and sheave | Measurement of the load between sheave and fixed point | Loss | |
|---|---|---|---|
| in kg | in kg | in kg | in % |
| 204 | 114 | 90 | 44.11764706 |
| 272 | 154 | 118 | 43.38235294 |
| 354 | 195 | 159 | 44.91525424 |
| 435 | 229 | 206 | 47.35632184 |
| 493 | 262 | 231 | 46.85598377 |
| 546 | 274 | 272 | 49.81684982 |
| | That is, a mean loss in % of the load | | 46.07 |

A loss of load of 45% after the sheave was observed, therefore the majority of the force is absorbed by the occurrences of friction induced. During the inspection of the rope, wear of the rope at the point of contact with the sheave was noticed, characterized by a partial rupture of the fibers and a partial fusion of the fibers together as a result of the heating generated by the forces of occurrences of friction. The sheave did not suffer any damage.

The second test relates to the ball-type sheave having a diameter of 57 mm. This test was carried out under the same conditions as for the sheave alone. In this test, the load line extends through the groove of the ball-type sheave.

Here is the table of results for the ball-type sheave:

| Measurement of the load between actuator and ball-type sheave | Measurement of the load between ball bearing sheave and fixed point | Loss | |
|---|---|---|---|
| in kg | in kg | in kg | in % |
| 93 | 85 | 8 | 8.602150538 |
| 118 | 111 | 7 | 5.93220339 |
| 213 | 189 | 24 | 11.26760563 |
| 291 | 257 | 34 | 11.6838488 |
| 340 | 305 | 35 | 10.29411765 |
| 415 | 358 | 57 | 13.73493976 |
| 446 | 400 | 46 | 10.31390135 |
| 557 | 497 | 60 | 10.77199282 |
| | That is, a mean loss in % of the load | | 10.33 |

After disassembling the system, no additional damage to the rope was noticed. However, the metal fixing element of the ball-type sheave was deformed. This is because with approximately 500 kilos on the rope and an angle of 180°, the charge applied to the ball-type sheave is close to a tonne, while the theoretical working load thereof is 500 kilos, therefore the pulley is damaged.

The third test relates to the pulley of the present invention with an angle α of 100°. This test was carried out under the same conditions as for the ball-type sheave, but the maximum traction load was increased because the working load is greater for the pulley of the present invention. The load line extends through the groove of the sheave 1.

| Measurement of load between actuator and pulley | Measurement of load between pulley and fixed point | Loss | |
|---|---|---|---|
| in kg | in kg | in kg | in % |
| 291 | 282 | 9 | 3.092783505 |
| 235 | 214 | 21 | 8.936170213 |
| 403 | 365 | 38 | 9.429280397 |
| 349 | 316 | 33 | 9.455587393 |
| 445 | 403 | 42 | 9.438202247 |
| 468 | 433 | 35 | 7.478632479 |
| 529 | 469 | 60 | 11.34215501 |
| 544 | 499 | 45 | 8.272058824 |
| 582 | 531 | 51 | 8.762886598 |
| 629 | 575 | 54 | 8.585055644 |
| | That is, a mean loss in % of the load | | 8.48 |

After disassembling the system, no damage to the sheave 11 of the pulley according to the invention was observed. The integrity of the pulley is retained. Furthermore, even under the load, the sheave 11 can rotate.

During the first test with the sheave alone, a great loss of load was found and therefore a very limited degree of efficiency and irreversible damage to the rope with the rupture of the core and partial fusion thereof. That damage did not occur in the second test and third test.

The second test sets out the limits of the ball-type sheave with a load of 500 kilos on the rope. The efficiency thereof is far better than the first test because the loss of load is only approximately 10%. The ball-type sheave effectively transmits the efforts and complies with the integrity of the rope during the use thereof. The disadvantages of the ball-type sheave remain its price, that is to say, 3 to 4 times greater than a pulley according to the present invention, and its weight, that is to say, 7 to 8 times greater in relation to a pulley according to the present invention.

The pulley of the present invention exhibits results which are really effective from all points of view. Thus, it has been found that the transmission of the effort is better than in the ball-type sheave, which proves the real efficiency of the present invention.

The invention claimed is:

1. A pulley comprising:

a monobloc sheave comprising two opposing longitudinal faces, a transverse central recess and a concave external surface forming an annular groove which is provided in order to redirect a rope, the central recess and the concave external surface being fixed relative to each other, a fixing rope of the sheave which extends through the central recess of the sheave, the fixing rope being in direct contact with the central recess, and a spacer element which is arranged in order to space the fixing rope away from the longitudinal faces of the sheave.

2. The pulley as claimed in claim 1, wherein the spacer element comprises two ends which project transversely relative to the longitudinal faces of the sheave, the two projecting ends being arranged in order to receive the fixing rope in abutment.

3. The pulley as claimed in claim 1, wherein the spacer element comprises two fixing means which are arranged at one side and the other of the longitudinal faces of the sheave, the fixing means being provided in order to fix the fixing rope to the spacer element.

4. The pulley as claimed in claim 1, wherein the fixing rope moves away from the sheave in two directions, one at each side of the sheave, in that the two directions together form an angle from 10° to 180°.

5. The pulley as claimed in claim 1, wherein the spacer element comprises an orientation groove of the sheave, the orientation groove being provided in order to cover at least a portion of the sheave.

6. The pulley as claimed in claim 1, wherein the fixing rope comprises two strands which extend through the central recess of the sheave.

7. The pulley as claimed in claim 6, wherein the spacer element is arranged in order to space apart the two strands in a parallel manner with the longitudinal faces.

8. The pulley as claimed in claim 6, wherein the fixing rope forms an endless loop, in that the spacer element is arranged in order to receive two cringles which are formed by the fixing rope at one side and the other of the central recess and in order to allow the pulley to be fixed by passing through the two cringles.

9. The pulley as claimed in claim 1, wherein the fixing rope comprises at least two strands which extend through the central recess of the sheave and in that the at least two strands are adjoining.

10. The pulley as claimed in claim 1, comprising a plurality of separate fixing ropes which each extend through the central recess.

11. The pulley as claimed in claim 10 comprising as many spacers as fixing ropes, each of which is associated with a fixing rope.

12. The pulley as claimed in claim 1, comprising:

a plurality of monobloc sheaves each comprising two opposing longitudinal faces, a transverse central recess and a concave external surface forming an annular groove which is provided in order to redirect a rope, the central recess and the concave external surface being fixed relative to each other, a fixing rope which is associated with each of the sheaves and which extends through the central recess of the corresponding sheave, the fixing rope being in direct contact with the central recess of the sheave involved, a spacer element which is arranged in order to laterally move the different fixing ropes away from the longitudinal faces of the corresponding sheaves.

13. The pulley as claimed in claim 1, wherein the sheave comprises a radiator which allows the heat generated by friction of the fixing rope in contact with the central recess to be dissipated by convection.

14. The pulley as claimed in claim 1, wherein the sheave comprises a cavity which is intended to receive a lubrication product and which is provided so as to lubricate the contact between the fixing rope and the central recess.

15. The pulley as claimed in claim 1, wherein the fixing rope comprises a closed loop which extends through the central recess and an extension which is intended to fix the pulley.

16. The pulley as claimed in claim 1, comprising a becket which is formed by a rope loop which extends through the central recess and which is in direct contact with the central recess.

17. The pulley as claimed in claim 1, further comprising:

a second fixing rope of the sheave which extends through the central recess of the sheave and which is in direct contact with the central recess, a second monobloc sheave comprising two opposing longitudinal faces, a second transverse central recess, and a second concave external surface forming an annular groove which is provided in order to redirect a rope, the second central recess and the second concave external surface being fixed relative to each other, a second spacer element which is arranged in order to space the second fixing rope away from the longitudinal faces of the two sheaves.

18. The pulley as claimed in claim 1, comprising a means for detecting exceeding of an effort taken up by the fixing rope.

19. The pulley as claimed in claim 1, comprising a temperature measuring means.

20. The pulley as claimed in claim 1, wherein the fixing rope moves away from the sheave in two directions, one at each side of the sheave, and the two directions together form an angle from 80° to 120°.

* * * * *